US008662957B2

(12) United States Patent
Paik et al.

(10) Patent No.: US 8,662,957 B2
(45) Date of Patent: Mar. 4, 2014

(54) LEAK PROOF PAD FOR CMP ENDPOINT DETECTION

(75) Inventors: Young J. Paik, Campbell, CA (US); Christopher R. Mahon, San Bruno, CA (US); Ashish Bhatnagar, Fremont, CA (US); Kadthala Ramaya Narendrnath, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 593 days.

(21) Appl. No.: 12/825,276

(22) Filed: Jun. 28, 2010

(65) Prior Publication Data

US 2010/0330879 A1 Dec. 30, 2010

Related U.S. Application Data

(60) Provisional application No. 61/222,045, filed on Jun. 30, 2009.

(51) Int. Cl.
*B24B 49/00* (2012.01)

(52) U.S. Cl.
USPC ..... 451/6; 451/8; 451/41

(58) Field of Classification Search
USPC ..... 451/6, 8, 41
See application file for complete search history.

(56) References Cited

U.S. PATENT DOCUMENTS

| | | | | |
|---|---|---|---|---|
| 5,645,469 | A * | 7/1997 | Burke et al. | 451/41 |
| 5,893,796 | A | 4/1999 | Birang et al. | |
| 6,248,000 | B1 | 6/2001 | Aiyer | |
| 6,273,806 | B1 | 8/2001 | Bennett et al. | |
| 6,586,337 | B2 | 7/2003 | Parikh | |
| 6,832,949 | B2 * | 12/2004 | Konno et al. | 451/285 |
| 6,951,506 | B2 * | 10/2005 | Andideh et al. | 451/41 |
| 7,118,457 | B2 * | 10/2006 | Swedek et al. | 451/41 |
| 7,258,602 | B2 * | 8/2007 | Shih et al. | 451/527 |
| 7,306,507 | B2 | 12/2007 | Benvegnu et al. | |
| 2004/0127145 | A1 * | 7/2004 | Takahashi et al. | 451/6 |
| 2005/0090187 | A1 | 4/2005 | Shih et al. | |
| 2007/0077862 | A1 | 4/2007 | Swedek et al. | |
| 2011/0183579 | A1 * | 7/2011 | Newelll | 451/28 |

FOREIGN PATENT DOCUMENTS

| | | |
|---|---|---|
| KR | 10-2004-0108008 | 12/2004 |
| KR | 10-2005-0051094 | 6/2005 |

OTHER PUBLICATIONS

International Search Report and Written Opinion in PCT/US2010/040238 dated Jan. 27, 2011, 10 pages.

* cited by examiner

*Primary Examiner* — Lee D Wilson
*Assistant Examiner* — Shantese McDonald
(74) *Attorney, Agent, or Firm* — Fish & Richardson P.C.

(57) ABSTRACT

In one aspect, a polishing pad includes a homogeneous unitary polishing layer having a polishing surface, an opposed bottom surface, a recess in the polishing surface extending partially but not entirely through the polishing layer, and a solid light-transmissive window is secured in the recess. In another aspect, a polishing pad includes a polishing layer having a polishing surface, and the polishing surface includes a first region having a first plurality of grooves with a first depth extending partially but not entirely through the polishing layer and a second region surrounded by the first region and having a second plurality of grooves with a second depth extending partially but not entirely through the polishing layer, the second depth greater than the first depth.

12 Claims, 5 Drawing Sheets

LEAK PROOF PAD FOR CMP ENDPOINT DETECTION

CROSS-REFERENCE TO RELATED APPLICATIONS

This application claims priority to U.S. Application Ser. No. 61/222,045, filed on Jun. 30, 2009, the entire disclosure of which is incorporated by reference.

TECHNICAL FIELD

This disclosure relates to a polishing pad for use in chemical mechanical polishing (CMP).

BACKGROUND

In the process of fabricating modern semiconductor integrated circuits (IC), it is often necessary to planarize the outer surface of a substrate. For example, planarization may be needed to polish away a conductive filler layer until the top surface of an underlying layer is exposed, leaving the conductive material between the raised pattern of the insulative layer to form vias, plugs and lines that provide conductive paths between thin film circuits on the substrate. In addition, planarization may be needed to flatten and thin an oxide layer to provide a flat surface suitable for photolithography.

One method for achieving semiconductor substrate planarization or topography removal is chemical mechanical polishing (CMP). A conventional chemical mechanical polishing (CMP) process involves pressing a substrate against a rotating polishing pad in the presence of an abrasive slurry.

In general, there is a need to detect when the desired surface planarity or layer thickness has been reached or when an underlying layer has been exposed in order to determine whether to stop polishing. Several techniques have been developed for the in-situ detection of endpoints during the CMP process. For example, an optical monitoring system for in-situ measuring of uniformity of a layer on a substrate during polishing of the layer has been employed. The optical monitoring system can include a light source that directs a light beam through a window in a polishing pad toward the substrate during polishing, a detector that measures light reflected from the substrate, and a computer that analyzes a signal from the detector and calculates whether the endpoint has been detected.

SUMMARY

In one aspect, a polishing pad includes a homogeneous unitary polishing layer having a polishing surface and an opposed bottom surface. The polishing layer has a recess in the polishing surface extending partially but not entirely through the polishing layer, the recess defining a recessed inner surface and a thinned region of the polishing layer between the recessed inner surface and the bottom surface. A solid light-transmissive window is secured in the recess. The window is more light-transmissive than the polishing layer.

Implementations can include one or more of the following. A backing layer may be secured to and abut the back surface of the polishing layer. The backing layer may include an aperture therethrough aligned with the recess. A top surface of the window may be coplanar with the polishing surface. A lower surface of the thinned region may be coplanar with the bottom surface of the polishing layer. The window may fill the recess. An adhesive in the recess may secure the window to the polishing layer. The thinned region may have a thickness less than about 30 mil. The polishing layer may be a porous plastic, e.g., cast polyurethane with embedded hollow microspheres or foamed polyurethane. The window may be substantially pure polyurethane.

In another aspect, a polishing pad includes a polishing layer having a polishing surface. The polishing surface includes a first region having a first plurality of grooves with a first depth extending partially but not entirely through the polishing layer and a second region surrounded by the first region and having a second plurality of grooves with a second depth extending partially but not entirely through the polishing layer, the second depth greater than the first depth.

Implementations can include one or more of the following. A backing layer may be secured to and abut the back surface of the polishing layer. The backing layer may include an aperture therethrough aligned with the second region. The polishing surface may include a plurality of second regions each surrounded by the first region. The plurality of second regions may be spaced at equal angular intervals around a center of the polishing pad. The first plurality of grooves may be uniformly spaced with a first pitch, and the second plurality of grooves may be uniformly spaced with a second pitch. The second pitch may be equal to or less than the first pitch. The first plurality of grooves be concentric circular arcs. The first pitch may be greater than a length of the second region. The second region may be a simple convex shape. The polishing layer may be circular with a diameter between about 30 inches and 31 inches, and the second region may be centered about 7.5 inches from a center of the polishing surface. A thickness of the polishing layer between a bottom surface of the polishing layer and a bottom of the second plurality of grooves is less than about 30 mil.

In another aspect, a polishing apparatus includes a platen, a polishing pad supported on the platen, and an optical monitoring system. The polishing pad includes a polishing layer having a polishing surface, the polishing surface including a first region having a first plurality of grooves with a first depth extending partially but not entirely through the polishing layer and a second region surrounded by the first region and having a second plurality of grooves with a second depth extending partially but not entirely through the polishing layer, the second depth greater than the first depth. The optical monitoring system includes a light source to direct a light through the second region of the polishing pad.

Implementations can include one or more of the following advantages. Optical monitoring can be conducted through an effectively leak-proof polishing pad. The polishing pad can be simple and low-cost to manufacture.

The details of one or more embodiments are set forth in the accompanying drawings and the description below. Other aspects, features, and advantages will be apparent from the description and drawings, and from the claims.

BRIEF DESCRIPTION OF DRAWINGS

Like reference symbols in the various drawings indicate like elements.

DETAILED DESCRIPTION

Endpoint detection windows in chemical mechanical polishing (CMP) pads can allow polishing liquid to leak through the pad and into the platen. The polishing liquid can flow around the edges of the window and leak into the aperture in the platen that houses the endpoint detection equipment. To counteract this leakage, during manufacturing of CMP polishing pads, a region of the polishing pad can be milled out leaving a thin layer. The thin layer has a sufficiently low opacity to allow light from the endpoint equipment to pass through the layer and reflect off of the substrate that is being polished and pass back though the layer such that the endpoint equipment can detect when polishing is completed.

In some implementations, the thin layer can support a transparent window. In other implementations, the density and depth of grooves formed in the polishing pad are increased in areas above the endpoint detection equipment. The thickness of the layers at the bottom of the grooves and the density of the grooves allow sufficient light to pass through the layer and reflect off of a substrate that is being processed.

Figure 1:
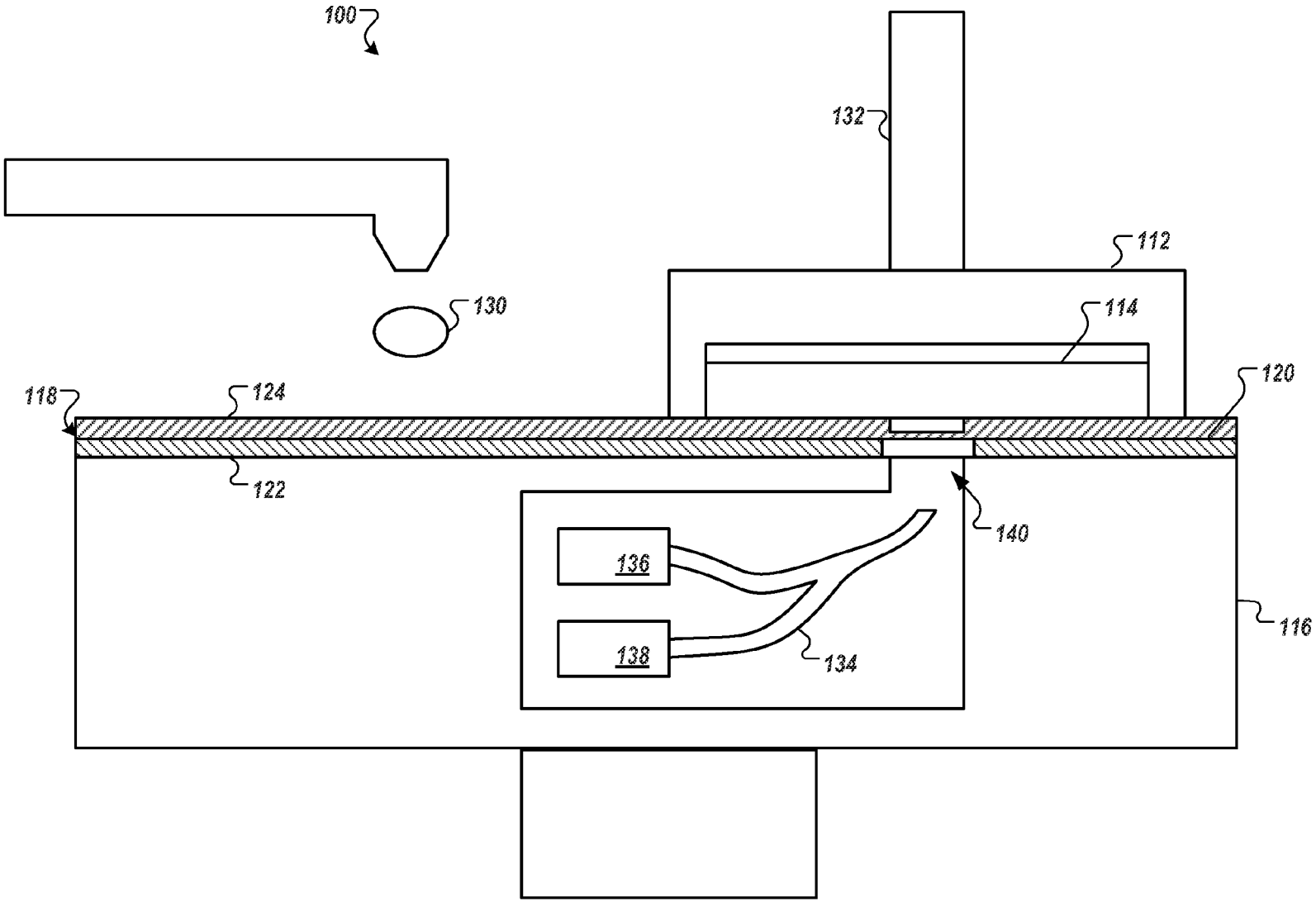
FIG. 1 is a schematic cross-sectional side view of a chemical mechanical polishing apparatus with an optical monitoring system for endpoint detection.

As shown in FIG. 1, a CMP apparatus 100 includes a polishing head 112 for holding a semiconductor substrate 114 against a polishing pad 118 on a platen 116.

The substrate can be, for example, a product substrate (e.g., which includes multiple memory or processor dies), a test substrate, a bare substrate, or a gating substrate. The substrate can be at various stages of integrated circuit fabrication, e.g., the substrate can be a bare wafer, or it can include one or more deposited and/or patterned layers. The term substrate can include circular disks and rectangular sheets.

The polishing head 112 applies pressure to the substrate 114 against a polishing surface 124 of the polishing pad 118 as the platen rotates about its central vertical axis. In addition, the polishing head 112 is usually rotated about its central axis, and translated across the surface of the platen 116 via a drive shaft or translation arm 132. A polishing liquid 130, e.g., an abrasive slurry, can be distributed onto the polishing pad 118. The pressure and relative motion between the substrate and the polishing surface, in conduction with the polishing liquid, result in polishing of the substrate. A conditioner can abrade the surface of the polishing pad 118 to maintain the roughness of the polishing pad 118. In some implementations, the polishing surface 124 includes grooves for distribution of the polishing liquid 130.

An optical monitoring system includes a light source 136, such as a white light source, and a detector 138, such as a photo spectrophotometer, in optical communication with a "window" 140 in the polishing pad 118. In this context, the "window" is a region that is more light-transmissive than the surrounding polishing pad. The light source 136 and the detector 138 can be located in and rotate with the platen 116, such that a monitoring light beam sweeps across the substrate 114 once per platen rotation. For example, a bifurcated optical fiber 134 can carry light from the light source 136 through the platen 116 to be directed through the window 140 onto the substrate 114, and light reflected from the substrate 114 can pass back through the optical fiber 134 to the detector 138. Alternatively, the light source 136 and the detector 138 can be stationary components located below the platen 116, and an optical aperture can extend through the platen below the window 140 to intermittently pass the monitoring light beam to the substrate. The light source 136 can employ a wavelength anywhere from the far infrared to ultraviolet, such as red light, although a broadband spectrum, e.g., white light, can also be used.

The polishing pad 118 can include a polishing layer 120 with the polishing surface 124 to contact the substrate and a backing layer 122 adhesively secured to the platen 116. The polishing layer 120 is manufactured as a unitary layer (e.g., a single continuous and contiguous layer without breaks) with a homogenous composition. The polishing layer 120 can be a material suitable for bulk planarization of the exposed layer on the substrate. Such a polishing layer can be formed of a polyurethane material, e.g., with fillers, such as hollow microspheres. The polishing layer can be porous. The pores can be provided by the hollow microspheres or by foaming during casting of the polishing material. In some implementations, the polishing layer 120 can be the IC-1000 or IC-1010 material available from Rohm & Hass. The backing layer 122 can be more compressible than the polishing layer 120. In some implementations, the polishing pad includes only the polishing layer, and/or the polishing layer is a relatively soft material suitable for a buffing process, such as a poromeric coating with large vertically oriented pores. In some implementations, grooves can be formed in the polishing surface 124.

Figure 2:
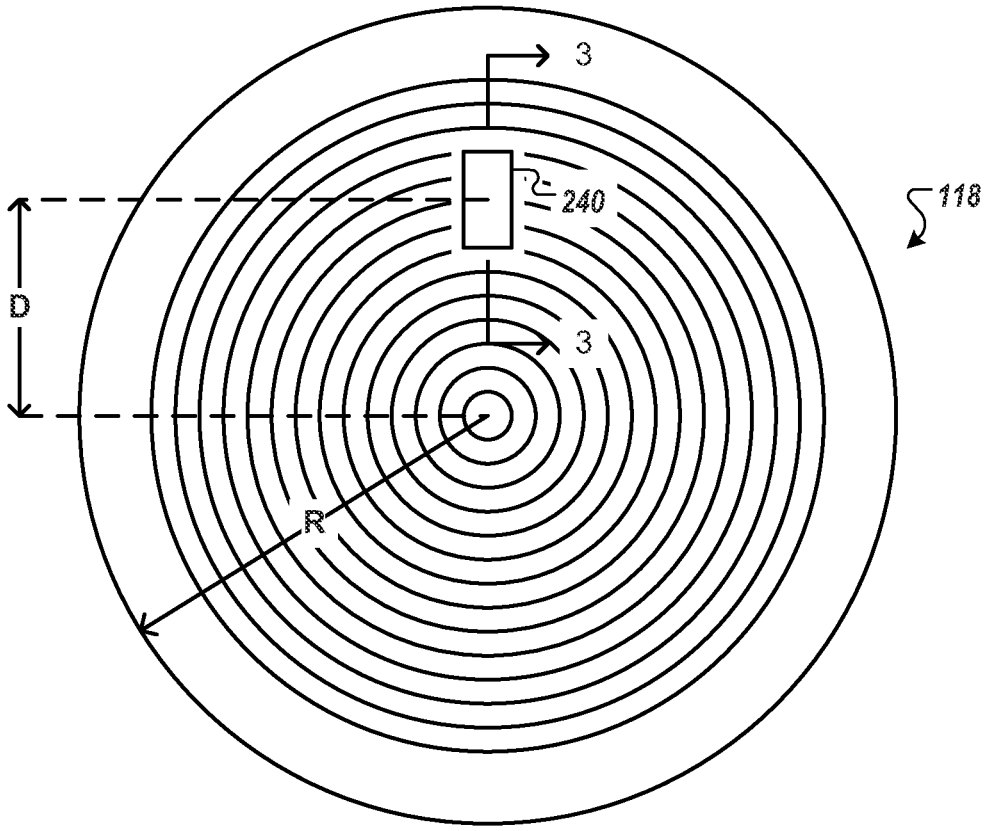
FIG. 2 is a simplified top view of the polishing pad of FIG. 1.

Referring to FIG. 2, in one implementation the polishing pad 118 has a radius R of 15.0 inches (381.00 mm), with a corresponding diameter of 30 inches. In some implementations, the polishing pad 118 has a radius of 15.25 inches (387.35 mm) or 15.5 inches (393.70 mm), with corresponding diameter of 30.5 inches or 31 inches. In other implementations, the diameter of the polishing pad 118 is between about 30 inches and about 31 inches. The optical monitoring system can use an area of the polishing pad about 0.5 inches (12.70 mm) wide and 0.75 inches (19.05 mm) long centered a distance D of 7.5 inches (190.50 mm) from the center of the polishing pad 118. Thus, the window 240 should cover at least this area. For example, the window 240 can have a length of about 2.25 (57.15 mm) inches and a width of about 0.75 inches (19.05 mm). The window 240 can have a width of at least 0.50 inches and a length of at least 0.75 inches. Both the polishing pad and the window can have a thickness of about 0.02 to 0.20 inches, e.g., 0.05 to 0.08 inches (1.27 to 2.03 mm). The window 240 can have a rectangular shape with its longer dimension substantially parallel to the radius of the polishing pad that passes through the center of the window. However, the window 240 can have other shapes, such as circular or oval, and the center of the window need not be located at the center of the area used by the optical monitoring system. In some implementations, the window 240 is the same as the window 140.

Figure 3:
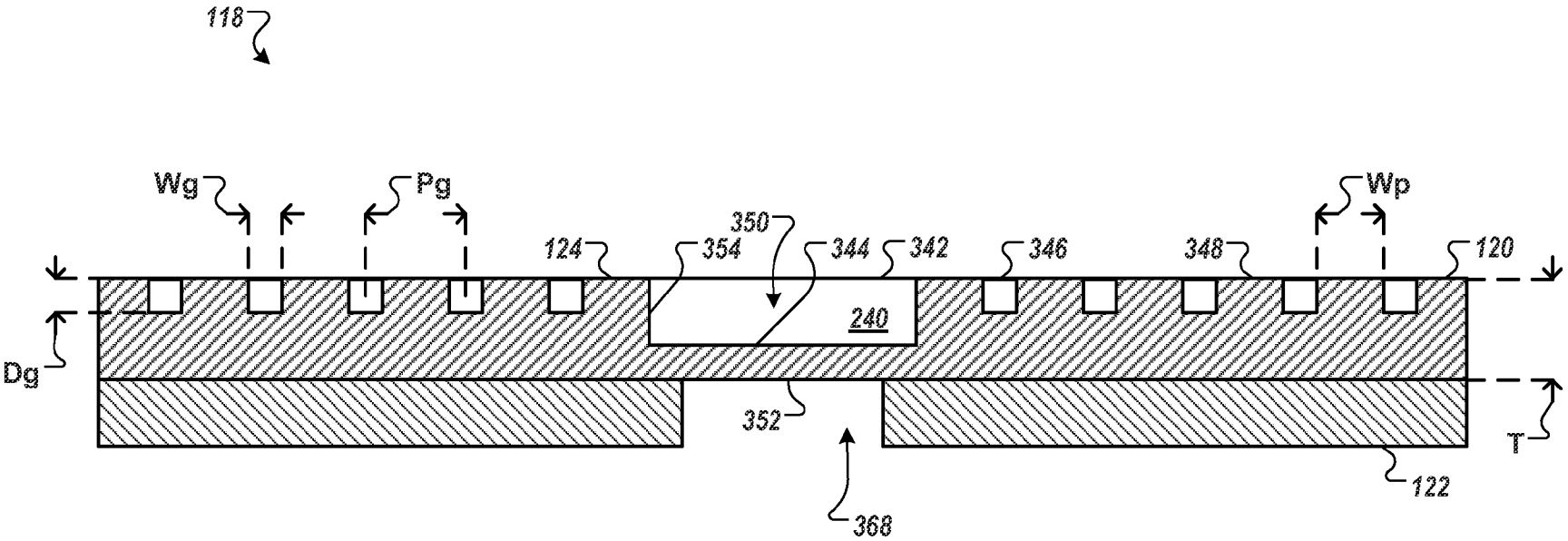
FIG. 3 is a cross-sectional view of a polishing pad of FIG. 2.

Referring to FIG. 3, a plurality of concentric circular grooves 346 are disposed in polishing surface 124 of polishing pad 118. The grooves 346 are milled out of the polishing layer 120 during manufacturing. The grooves 346 can be uniformly spaced with a pitch Pg. The pitch Pg is the radial distance between adjacent grooves. In other implementations, the grooves 346 are not uniformly spaced across the top of the polishing layer 120 but are spaced to provide good polishing for substrates 114. Between each groove 346 is an annular partition 348 having a width Wp. Each groove 346 includes walls which terminate in a substantially U-shaped or flat base portion. Each groove may have a depth Dg and a width Wg.

The walls may be generally perpendicular. Each polishing cycle results in wear of polishing pad 118, generally in the form of thinning of the polishing layer 120 as the polishing surface 124 is worn down. The width Wg of a groove with substantially perpendicular walls does not change as the polishing layer 120 is worn. Thus, the generally perpendicular walls ensure that the polishing pad has a substantially uniform surface area over its operating lifetime.

The grooves 346 have a minimum width Wg of about 0.015 inches. Each groove 346 may have a width Wg between about 0.15 and 0.04 inches, e.g., a width Wg of approximately 0.02 inches. Each partition 348 may have a width Wp between about 0.075 and 0.20 inches, e.g., a width Wp of approximately 0.10 inches. Accordingly, the pitch Pg between the grooves 346 may be between about 0.09 and 0.24 inches, e.g., the pitch Pg may be approximately 0.12 inches.

The ratio of groove width Wg to partition width Wp may be selected to be between about 0.10 and 0.25. The ratio may be approximately 0.2. If the grooves are too wide, the polishing pad will be too flexible, and the "planarizing effect" will occur. On the other hand, if the grooves are too narrow, it becomes difficult to remove waste material from the grooves. Similarly, if the pitch is too small, the grooves will be too close together and the polishing pad will be too flexible. On the other hand, if the pitch is too large, slurry will not be evenly transported to the entire surface of the substrate.

The grooves 346 have a depth Dg of at least about 0.02 inches. The depth Dg may be between about 0.02 and 0.05 inches, e.g., the depth Dg of the grooves may be approximately 0.03 inches. The polishing layer 120 can have a thickness T between about 0.05 and 0.12 inches. As such, the thickness T can be about 0.05 or 0.08 inches.

A recess 350 is milled out of the polishing layer 120 during manufacturing leaving a thin region 352 of the polishing layer 120. The recess 350 is formed such that it does not go all the way through the polishing layer 120. Sidewalls 354 of the recess 350 can be formed perpendicular to the polishing surface 124 of the polishing layer 120 so that as the polishing pad 118 is worn down during processing of substrates 114, the sidewalls 354 remain substantially perpendicular to the polishing surface 124 to ensure that the polishing pad 118 has a substantially uniform surface area over its operating lifetime. In some implementations, the polishing layer 120 is manufactured in a mold such that the grooves 346 and/or the recess 350 are formed in the polishing surface 124 by the molding process. In some implementations, the recess 350 and the grooves 346 are etched out of the polishing layer 120. In some implementations, the recess 350 is chiseled out of the top of the polishing layer 120. In some implementations, multiple thin regions 352, e.g., 1 to 6 regions, e.g., 3 regions, are milled in the polishing layer 120 (only one region is shown in FIG. 2). Where multiple thin regions are formed, they can be distributed at the same radial distance from and at equal angular intervals around the center of the polishing pad.

The window 240 includes a top surface 342 and a bottom surface 344. The polishing layer 118 completely surrounds the window 240. In other implementations, the polishing layer 118 partially surrounds the window 240.

In some implementations, the edges of the window 240 and the edges of polishing layer 120 surrounding the window 240 create a seal to prevent the polishing liquid 130 from flowing around the window 240. The window 240 can be joined to the polishing layer 120 without adhesive, e.g., the abutting edges of the window 240 and polishing layer 120 are molded together. In other implementations, an adhesive placed around the edges of the window 240 forms the seal.

An aperture 368 in the backing layer 122 is aligned with the window 240 in the polishing layer 120. The width and length of the aperture are smaller than the width and length of the window 240. In some implementations, the width and length of the aperture are the same size as the width and length of the window 240. In other implementations, the width and length of the aperture are larger than the width and length of the window 240.

At least one thin region 352, e.g., each thin region 352, supports a window 240 that sits in the recess 350. The thin region 352 prevents polishing liquid 130 from leaking into the aperture 368 below the polishing layer 120. If polishing liquid 130 contacts the light source 136 and/or the detector 138, the polishing liquid 130 can block transmission of light or cause a short to occur.

The thin region 352 is made from the same material, i.e., has the same composition, as the rest of the polishing layer 120. In some implementations, the polishing layer 120 is made from polyurethane. The thin region 352 has the same opacity per unit thickness as the rest of the polishing layer 120. The thin region 352 has a thickness between about 0.0001 inches and about 0.03 inches, e.g., between about 0.001 and about 0.02 inches thick, e.g., between about 0.001 and about 0.01 inches thick. The thickness of the thin region 352 is selected such that enough light can pass through the thin region 352 and reflect off of a substrate that is being polished and the detector 138 can monitor the reflected light. The recess 350 extends through about 50% to about 99.875% of the thickness of the polishing layer 120, e.g., through about 75% to about 95% of the polishing layer 120. About 95% of the polishing layer 120 can be milled out to form the recess 350.

In some implementations, the recess 350 is rectangular and has a width of at least 0.50 inches and a length of at least 0.75 inches. In some implementations, the recess 350 has at most a width of about 1 inch and at most a length of about 3 inches. For example, the recess 350 can be between about 0.75 inches to about 1 inch wide and between about 1.5 to about 2.5 inches long. For example, the recess 350 can be approximately 0.75 inches wide and approximately 1.5 inches long.

The top surface 342 of the window 240 is coplanar with the polishing surface 124 of the polishing layer 120 such that the window 240 fills the recess 350 above the thin region 352. In other implementations, the top surface 342 of the window 240 is slightly below the plane formed by the polishing surface 124 of the polishing layer 120. The bottom surface 344 rests on the top surface of the thin layer 352. The window 240 can be joined to the polishing layer 120 with adhesive on the sides and/or bottom of the window 240. In other implementations, the window 240 and the polishing layer 120 are molded together without adhesive, or the window 240 is simply press fit into the recess 350. The window 240 can be a solid light-transmitting material, e.g., a transparent material, such as a relatively pure polyurethane without fillers. The window 240 is more light transmissive than the polishing layer 120 (e.g., the window 240 has a lower attenuation coefficient than the polishing layer 120).

The window 240 fits into and can have the same lateral shape as the recess 350, e.g., the window can be the same size or slightly smaller than the recess 350. The window can be rectangular and have a width of at least 0.50 inches and a length of at least 0.75 inches and a width of at most about 1 inch and a length of at most about 3 inches. The window 240 has a thickness approximately equal or slightly less than the depth of the recess 350. In some implementations, the window 240 has a simple convex shape, e.g., a circle, oval or simple convex polygon. When the window 240 is circular, a lateral dimension of the window 240 can be the same as either the width or the length of the window 240.

In some implementations, the polishing pad 118 is manufactured from a porous plastic. The polishing pad can be manufactured from cast polyurethane with embedded hollow microspheres, with the microspheres providing the pores. Alternatively, the pores can be provided foaming during casting of the polishing material. In certain implementations, the polishing pad is manufactured from flexible or rigid foamed polyurethane. In other implementations, the polishing pad 118 is manufactured from substantially pure polyurethane.

In certain implementations, the length of the window 240 is greater than the pitch Pg between the grooves 346. The grooves can stop short of the window 240 such that they do not intersect the window 240.

Figure 4:
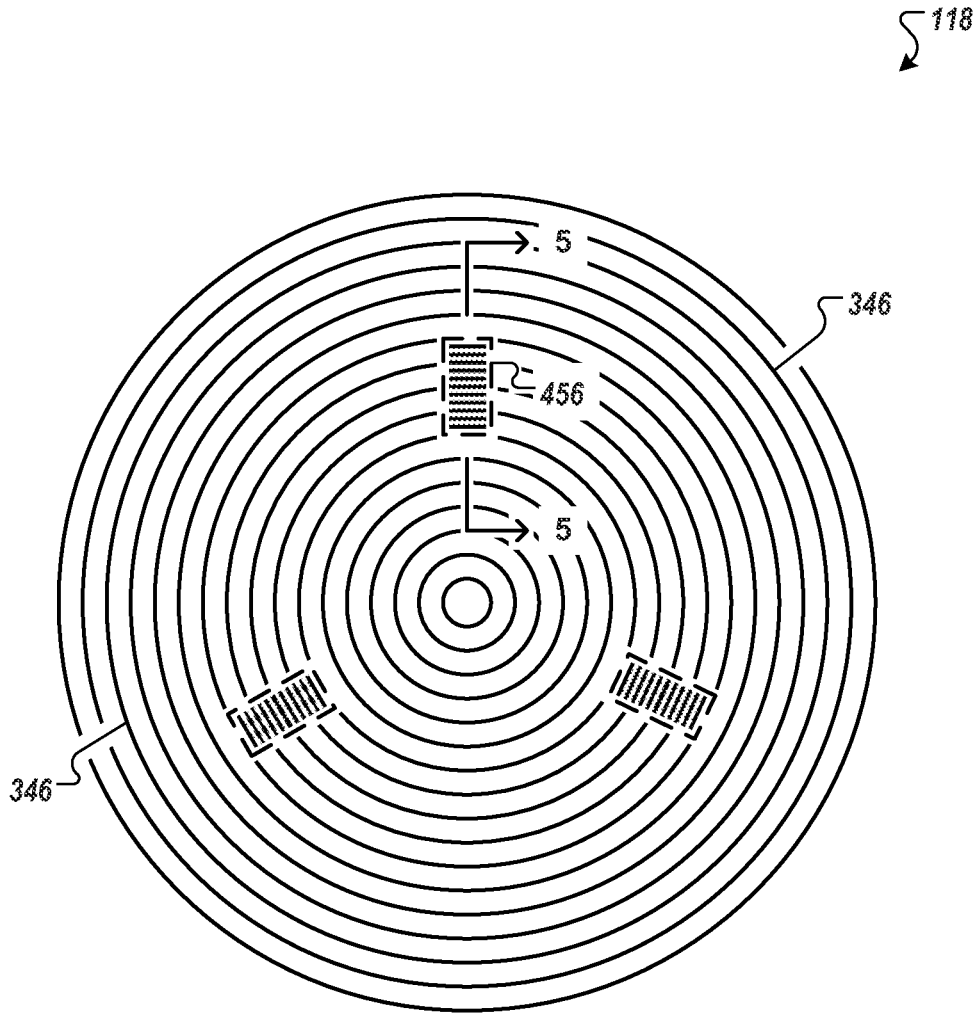
FIG. 4 is a top view of a polishing pad with three regions that have a high density of grooves.
Figure 5:
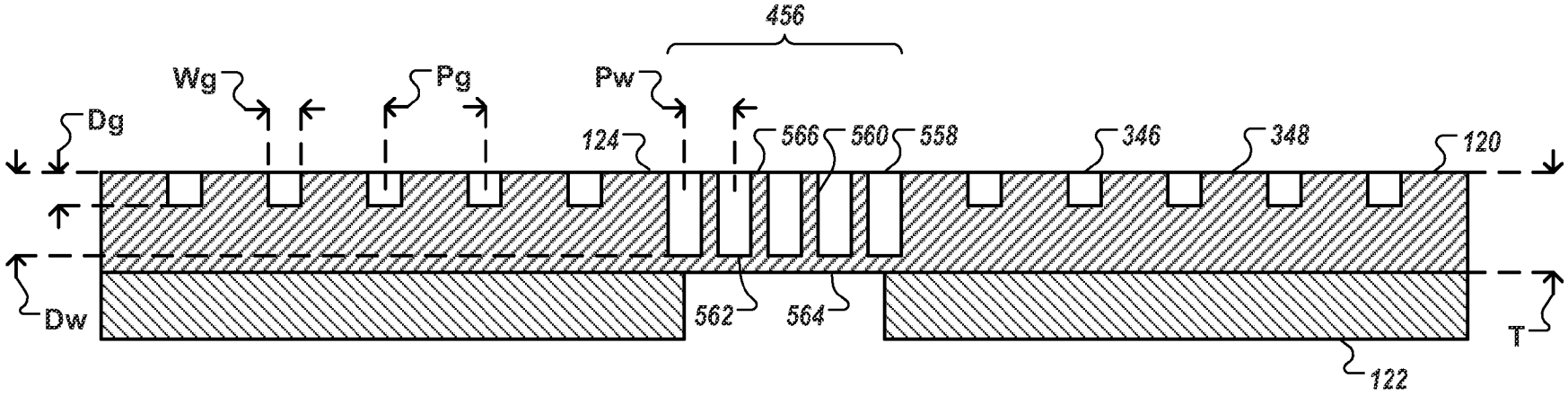
FIG. 5 is a cross-sectional view of part of the polishing pad of FIG. 4.

Referring to FIGS. 4 and 5, in another implementation, the window can be provided by a region in which grooves are deeper, wider or more closely spaced than in the surrounding polishing pad. The groove depth, width, and length are selected such that light from endpoint equipment can pass through the layer 120 at the bottom of the groove, reflect off of the substrate 114 that is being polished, pass back through the layer 120, and be monitored by the detector 138. Thus, the detector 138 can determine when the polishing pad 118 should stop polishing the substrate 114. The polishing pad 118 includes at least one region 456 that is surrounded both radially (r) and angularly (θ) by the rest of the polishing pad 118. There can be three regions 456 located in the polishing pad 118. In other implementations, there are between one and six regions 456. The regions 456 are uniformly spaced around the center of the polishing pad 118.

Grooves located in the regions 456 can have a smaller pitch than the grooves 346 in the rest of the polishing pad 118. The pitch Pg between the grooves 346 is between about 0.09 and 0.24 inches, e.g., approximately 0.12 inches. During manufacture of the polishing pad 118, the grooves 346 are milled in concentric circular arcs. In other implementations, the grooves 346 are milled in straight lines across the polishing pad 118.

The regions 456 can be rectangular and have a width of at least 0.50 inches and a length of at least 0.75 inches. The regions 456 have at most a width of about 1 inch and at most a length of about 3 inches. In particular, the regions 456 are between about 0.75 inches to about 1 inch wide. In particular, the regions 456 are between about 1.5 to about 2.5 inches long. Specifically, the regions 456 are 0.75 inches wide and 1.5 inches long. The regions 456 have a thickness between about 0.02 inches to about 1 inch, e.g., between about 0.05 inches to about 0.08 inches thick, e.g., approximately 0.07 inches. In some implementations, the regions 456 have a simple convex polygonal shape. In other implementations, the regions 456 are circular or oval. When the regions 456 are circular, a lateral dimension of the regions 456 can be the same as either the width or the length of the regions 456.

The regions 456 are positioned the same distance radially from the center of the polishing layer 118. In some implementations, regions 456 have different positions radially on the top of the polishing layer 120. For example, the polishing layer 120 can include 3 regions 456 centered at a distance of 7.5 inches radially from the center of the polishing layer 120 and 3 regions 456 centered at a distance of 3.2 inches radially from the center of the polishing layer 120. In particular, the regions 456 are milled in the polishing layer 120 at between about 2 and about 6 different radii, e.g., between about 2 and about 3 different radii. In certain implementations, the regions 456 have different positions radially on the top of the polishing layer 120 and the regions 456 have a different frequency. For example, the polishing layer can include 3 regions 456 centered at a distance of 8 inches radially from the center of the polishing layer 120 and 2 regions centered at a distance of 2 inches radially from the center of the polishing layer 120.

Referring to FIG. 5, the polishing pad 118 includes grooves 558 located in the regions 456. During manufacture of the polishing pad 118, the grooves 558 are milled out of the polishing pad 118. The grooves 558 include sidewalls 560 and a bottom surface 562. The sidewalls 560 are formed perpendicular to the polishing surface 124 of the polishing layer 120 and perpendicular to the bottom surface 562. The bottom of the grooves 558 are generally U-shaped to allow polishing liquid 130 to easily flow through the grooves 558, to allow the grooves 558 to be easily cleaned, and to prevent buildup of the cleaning liquid 130. The bottom surface 562 is not planar because of the generally U-shaped bottom of the grooves 558. In other implementations, the bottom of the grooves 558 is flat and the bottom surface 562 is planar. As the polishing pad 118 is worn down during processing of substrates 114, the sidewalls 558 remain substantially perpendicular to the polishing surface 124 to ensure that the polishing pad 118 has a substantially uniform surface area over its operating lifetime.

Bridges 564 connect partitions 566 together. The partitions 566 are located between the grooves 558. The bridges 564 prevent polishing liquid 130 from passing through the polishing layer 120 and leaking into the platen 116. The bridges 564 have the same opacity per unit thickness as the rest of the polishing layer 120. The bridges 564 have a thickness between about 0.0001 inches and about 0.03 inches, e.g., between about 0.001 and about 0.02 inches thick, e.g., between about 0.001 and about 0.01 inches thick. The depth Dw, pitch Pw, and width of the grooves 558 are selected such that enough light can pass through the bridges 564 and reflect off of a substrate that is being polished and the detector 138 can monitor the reflected light.

The ratio of the groove 558 surface area to the partition 566 surface area is higher in the window region than the ratio of the groove 346 surface area to the partition 348 surface area in the surrounding polishing pad. Although the grooves 559 are illustrated as only parallel linear grooves extending normal to the radius passing through their center, in some implementations, the grooves 558 can curved, or include linear grooves extending in two perpendicular directions, e.g., both substantially radially and normal to the radius. Similarly, although the partitions 566 are illustrated as parallel stripes, in some implementations, the partitions 566 can be rectangular islands.

The top surface of the partitions 566 is coplanar with the polishing surface 124 of the polishing layer 120. In some implementations, the top surface of the partitions 566 is below the plane formed by the polishing surface 124 (but above the bottom of the grooves 558).

The width of the grooves 558 is the same as the width of the grooves 346. In other implementations, the grooves 558 have a different width than the grooves 346, e.g., the grooves 558 are wider than the grooves 346. The grooves 558 have a minimum width Wg of about 0.015 inches. Each groove 558 may have a width Wg between about 0.15 and about 0.06 inches, e.g., a width Wg of approximately 0.02 inches. The pitch Pw between the grooves 558 is uniform and is between about 0.04 and 0.13 inches, e.g., approximately 0.05 inches. The depth Dw of the grooves 558 is between about 0.05 inches and about 0.08 inches, e.g., between about 0.078 and about 0.0799 inches, e.g., approximately 0.079 inches.

The grooves 558 fit within the window area, and therefore are at most 3 inches long. In some implementations, the grooves 558 end in a wall perpendicular to the polishing surface 124. In other implementations, at the ends of the grooves 558, the bottom surface 562 of the grooves 558 curve or slant upwardly. In certain implementations, the grooves 558 connect to an annular groove, such as one of the grooves 346. For example, at the ends of the grooves 558, the bottom surface 562 curves upward until the depth of the groove 558 is the same as the depth Dg of the grooves 346.

The grooves 558 extend about 50% to about 99.875% of the way through the polishing layer 120, e.g., about 75% to about 99% of the polishing layer 120, e.g., approximately 99%. The ratio of the groove 558 width Wg to the groove depth Dw can be selected between about 0.25 and about 2, e.g., between about 0.1875 and about 1, e.g., approximately 0.25.

In certain implementations, the width of the regions 456 is less than the pitch Pg between the grooves 346, e.g., less than 0.24 inches, e.g., less than approximately 0.12 inches.

Before installation on a platen, the polishing pad 118 can also include a pressure sensitive adhesive and a liner that spans the bottom surface 122 of the polishing pad. In use, the liner is peeled away, and the polishing pad 118 is applied to the platen with the pressure sensitive adhesive. The pressure sensitive adhesive and liner can span the window 140, or either or both can be removed in and immediately around the region of the window 140.

A number of embodiments of the invention have been described. Nevertheless, it will be understood that various modifications may be made without departing from the spirit and scope of the invention. For example, the polishing pad 118 can be manufactured from polyethylene. Many other groove patterns are possible in addition to concentric circular grooves, such as parallel linear grooves, "XY" grooves (linear grooves running in two perpendicular directions) and serpentine grooves. Accordingly, other embodiments are within the scope of the following claims.

What is claimed is:

1. A polishing pad, comprising:

a polishing layer having a polishing surface, the polishing surface including a single contiguous first region having a first plurality of grooves with a first depth extending partially but not entirely through the polishing layer and a second region surrounded by the first region both radially and angularly and having a second plurality of grooves with a second depth extending partially but not entirely through the polishing layer, the second depth greater than the first depth.

2. The polishing pad of claim 1, further comprising a backing layer secured to and abutting a back surface of the polishing layer, the backing layer including an aperture therethrough aligned with the second region.

3. The polishing pad of claim 1, wherein the polishing surface includes a plurality of second regions each surrounded by the first region.

4. The polishing pad of claim 3, wherein the plurality of second regions are spaced at equal angular intervals around a center of the polishing pad.

5. The polishing pad of claim 1, wherein the first plurality of grooves are uniformly spaced with a first pitch, and the second plurality of grooves are uniformly spaced with a second pitch.

6. The polishing pad of claim 5, wherein the second pitch is equal to or less than the first pitch.

7. The polishing pad of claim 5, wherein the first plurality of grooves comprises concentric circular arcs.

8. The polishing pad of claim 7, wherein a thickness of polishing layer between a bottom surface of the polishing layer and a bottom of the second plurality of grooves is less than about 30 mil.

9. The polishing pad of claim 5, wherein the first pitch is greater than a length of the second region.

10. The polishing pad of claim 1, wherein the second region is a simple convex shape.

11. The polishing pad of claim 1, wherein the polishing layer is circular with a diameter between about 30 inches and 31 inches, and the second region is centered about 7.5 inches from a center of the polishing surface.

12. A polishing apparatus, comprising:

a platen;

a polishing pad supported on the platen, the polishing pad including a polishing layer having a polishing surface, the polishing surface including a single contiguous first region having a first plurality of grooves with a first depth extending partially but not entirely through the polishing layer and a second region surrounded both radially and angularly by the first region and having a second plurality of grooves with a second depth extending partially but not entirely through the polishing layer, the second depth greater than the first depth; and an optical monitoring system including a light source to direct a light through the second region of the polishing pad.

* * * * *